US006595677B2

(12) United States Patent
Anderson

(10) Patent No.: US 6,595,677 B2
(45) Date of Patent: Jul. 22, 2003

(54) PORTABLE MORTAR MIXER WITH OSCILLATING PADDLE AND SCRAPER

(76) Inventor: Zachery D. Anderson, P.O. Box 11976, Spokane, WA (US) 99211

( * ) Notice: Subject to any disclaimer, the term of this patent is extended or adjusted under 35 U.S.C. 154(b) by 0 days.

(21) Appl. No.: 09/878,757

(22) Filed: Jun. 11, 2001

(65) Prior Publication Data

US 2002/0018397 A1 Feb. 14, 2002

Related U.S. Application Data

(60) Provisional application No. 60/210,396, filed on Jun. 9, 2000.

(51) Int. Cl.[7] ..... B28C 5/12
(52) U.S. Cl. ..... 366/67; 366/276
(58) Field of Search ..... 366/26, 60, 61, 366/62, 64–67, 276–278

(56) References Cited

U.S. PATENT DOCUMENTS

| | | | | |
|---|---|---|---|---|
| 54,597 | A | * | 5/1866 | Quick |
| 78,706 | A | * | 6/1868 | Wood |
| 506,404 | A | * | 10/1893 | Kyte |
| 1,714,588 | A | * | 5/1929 | Bushnell |
| 1,823,637 | A | * | 9/1931 | Wright |
| 2,784,950 | A | * | 3/1957 | Bakewell |
| 3,372,910 | A | * | 3/1968 | Estis |
| 3,407,872 | A | | 10/1968 | Crane |
| 3,955,532 | A | * | 5/1976 | Hall et al. |
| 4,473,001 | A | * | 9/1984 | Rieger |
| 4,478,515 | A | * | 10/1984 | Tobin |
| 4,956,821 | A | * | 9/1990 | Fenelon |
| 5,261,746 | A | * | 11/1993 | Boasso |
| 5,386,943 | A | * | 2/1995 | Peeters |
| 5,489,150 | A | * | 2/1996 | Whiteman, Jr. |
| 5,671,862 | A | | 9/1997 | Cobos |

FOREIGN PATENT DOCUMENTS

| | | | |
|---|---|---|---|
| CH | 629071 | * | 4/1982 |
| EP | 893070 | * | 1/1999 |

* cited by examiner

*Primary Examiner*—Charles E. Cooley
(74) *Attorney, Agent, or Firm*—Richard C. Conover

(57) ABSTRACT

A portable mixer having an open-top, semicircular mixing trough supported by a base fixedly mounted to the mixing trough. The base is provided with a pair of spaced-apart box channels extending through the base for receiving forklift tines. A paddle is positioned within the mixing tub, and is mounted in cantilever fashion to an axle with the paddle mounted in depending relation to the axle. The axle is carried by a bearing located outside the trough and the axle is aligned with the axial center of the semicircular trough. An actuating system is used to rotate the axle back and forth causing the paddle to sweep back and forth within the trough.

8 Claims, 10 Drawing Sheets

PORTABLE MORTAR MIXER WITH OSCILLATING PADDLE AND SCRAPER

Applicant claims priority based upon a previously filed co-pending provisional application Ser. No. 60/210,396 filed Jun. 9, 2000.

BACKGROUND OF INVENTION

This invention relates to a portable mortar mixer to be used by contractors and builders.

Mechanical mixers for mixing or churning materials are known. See, for example, U.S. Pat. No. 54,597 to Quick; U.S. Pat. No. 78,706 to Wood; U.S. Pat. No. 506,404 to Kyte; U.S. Pat. No. 1,714,588 to Bushnell; U.S. Pat. No. 2,784,950 to Bakewell; and U.S. Pat. No. 3,372,910 to Estis.

None of the known mixers are portable. What is needed is a portable mortar mixer which can be transported from job site to job site easily, and also can be lifted to a position at a building site adjacent where the workman is using mortar. The advantage of the present invention is that it can be operated and used where the operator is located thereby eliminating the need to transport mixed mortar to the workman.

Further, known mixers have an axle holding the paddle, which axle extends across the entire mixing tub. What is needed is a paddle mounted to the axle in cantilever fashion so that the paddle can be moved to one side and the mixing tub cleaned without interference of the axle.

Further what is needed is a mortar mixer where the axle bearings are located outside the trough where mixing occurs so that the mortar does not interfere with the operation of the bearings.

SUMMARY OF INVENTION

A portable mixer having an open-top, semicircular mixing trough supported by a base fixedly mounted to the mixing trough. The base is provided with a pair of spaced-apart box channels extending through the base for receiving forklift tines. A paddle is positioned within the mixing tub, and is mounted in cantilever fashion to an axle with the paddle mounted in depending relation to the axle. The axle is carried by a bearing located outside the trough and the axle is aligned with the axial center of the semicircular trough. An actuating system is used to rotate the axle back and forth causing the paddle to sweep back and forth within the trough.

DESCRIPTION OF THE DRAWINGS

In order that the invention may be clearly understood and readily carried into effect, a preferred embodiment of the invention will now be described, by way of example only, with reference to the accompanying drawings wherein.

DESCRIPTION OF A PREFERRED EMBODIMENT

A portable mortar mixer 10, according to the present invention, is shown in FIGS. 1–5. The portable mortar mixer includes a mixer tub base 12 which supports a mixer tub assembly 14.

Figure 1:
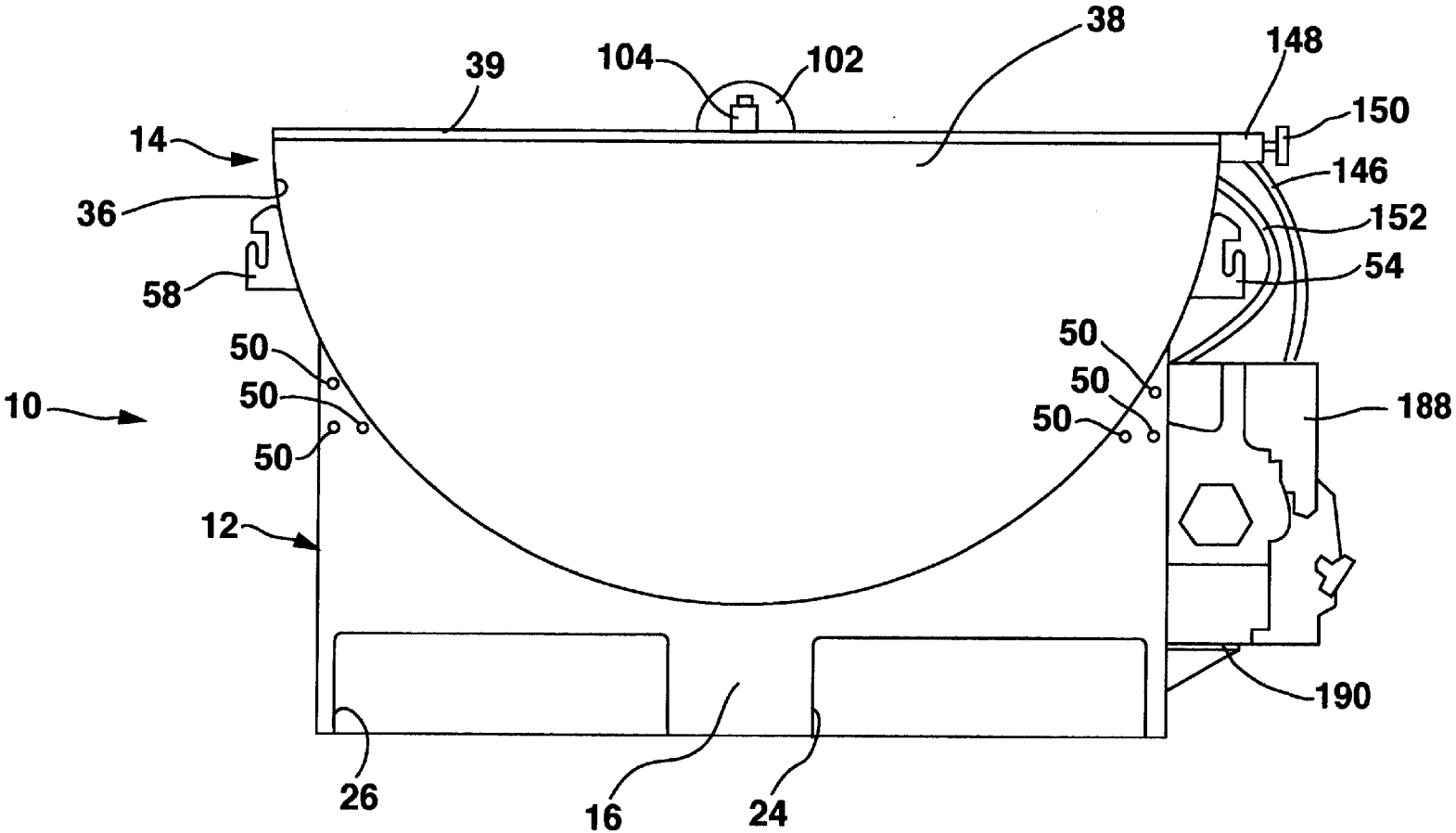
FIG. 1 is a front elevational view of the present invention.
Figure 2:
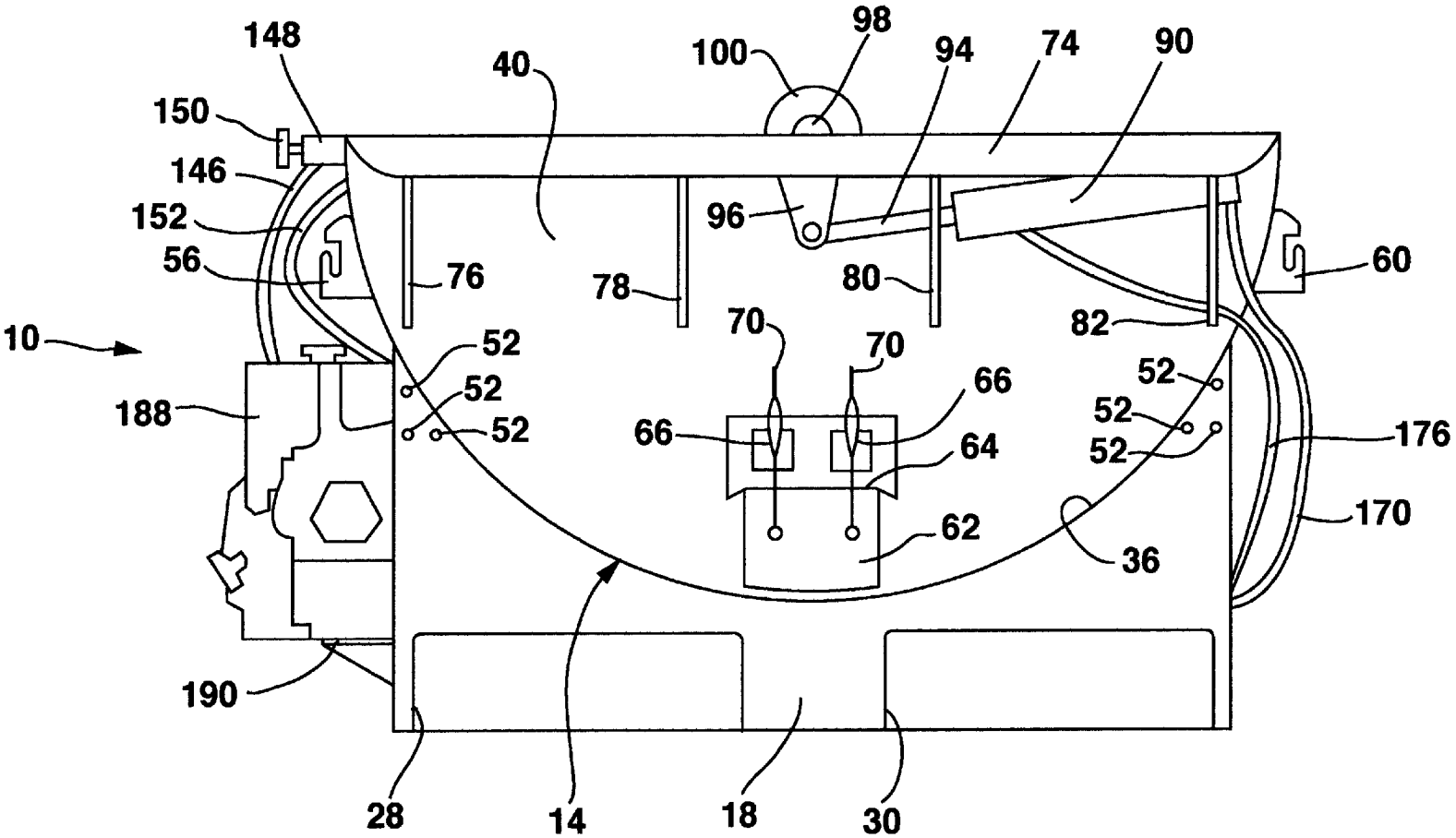
FIG. 2 is a rear elevational view of the invention shown in FIG. 1.
Figure 3:
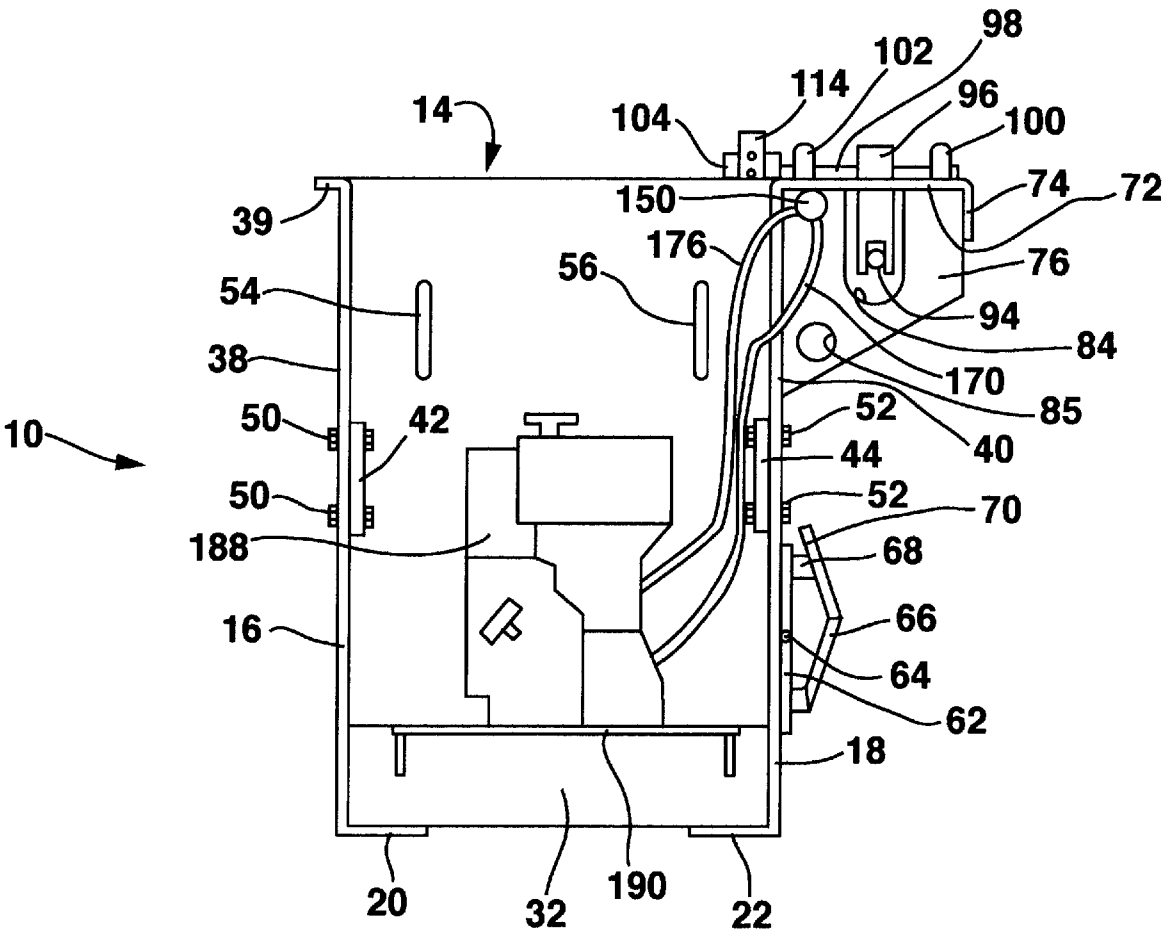
FIG. 3 is a right side elevational view of the invention shown in FIG. 1.
Figure 4:
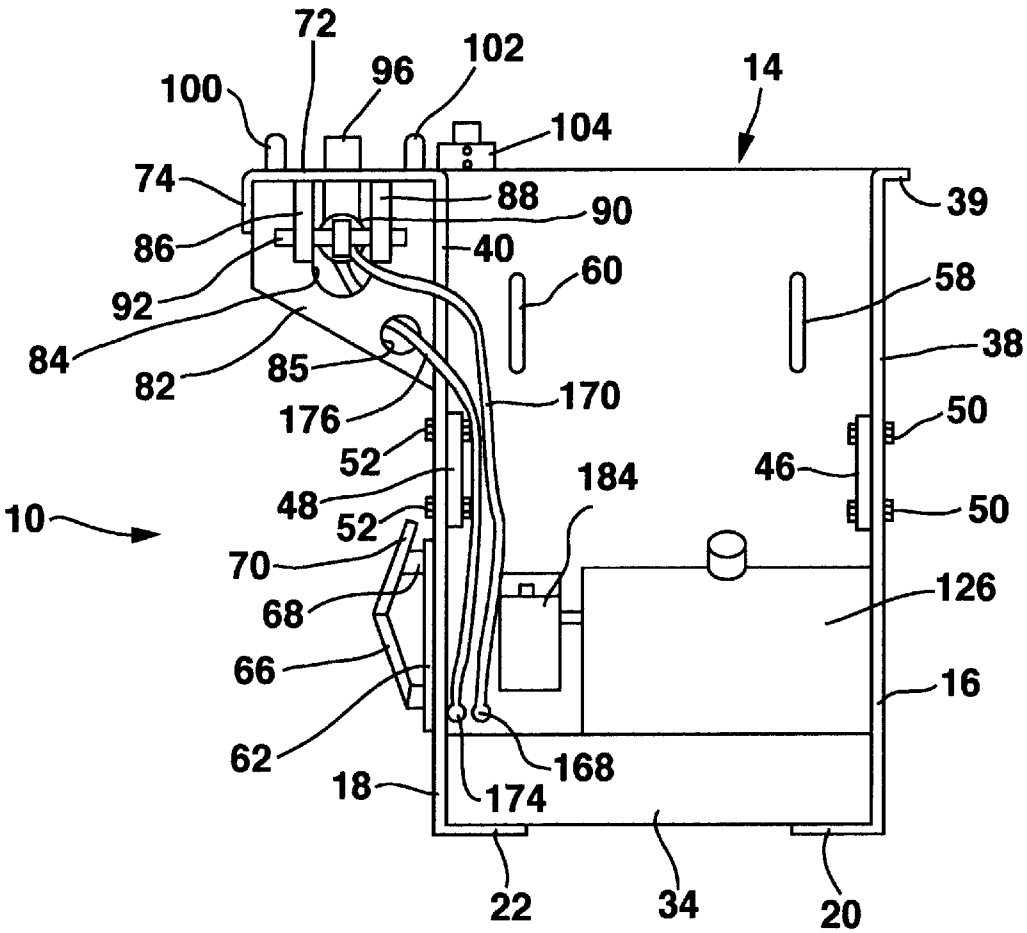
FIG. 4 is a left side elevational view of the invention shown in FIG. 1.

The base 12 includes a front wall 16 and a correspondingly shaped rear wall 18. Each of the walls 16 and 18 have an upper tub support edge which has a semicircular shape, as shown in FIGS. 1 and 2. The lower edges of front wall 16 and rear wall 18 have inwardly depending lips 20 and 22 respectively, as shown in FIGS. 3 and 4.

The front wall 16 is further provided with a rectangular cutout 24 and a second rectangular cutout 26, as shown in FIG. 1. The rear wall is similarly provided with cutouts 28 and 30, as shown in FIG. 2, aligned with cutouts 24 and 26.

A squared "U"-shaped box channel 32 (shown in FIGS. 3 and 9), opening downwardly, rests on lips 20 and 22, and has one end welded to front wall 16 in alignment with cutout 26. The other end of channel 32 is welded to rear wall 18 in alignment with cutout 30. A squared "U"-shaped box channel 34 (shown in FIGS. 4 and 9), opening downwardly, rests on lips 20 and 22, and has one end welded to front wall 16 in alignment with cutout 24. The other end of channel 34 is welded to rear wall 18 in alignment with cutout 28. The channels 32 and 34 maintain the front wall and rear wall in spaced-apart and parallel relation. The channels 32 and 34 also provide a guide slot for receiving forklift tines when used to transport the mixer from one location to another.

Tub 14 includes a semicircular trough wall 36 and a pair of semicircular plate end walls 38 and 40, as shown in FIGS. 1 and 2. The end wall 38 has an outwardly extending lip 39, as shown in FIGS. 1 and 3. The semicircular shaped tub 14 nests upon the semicircular shaped upper edges of front wall 16 and rear wall 18, as shown in FIGS. 1 and 2.

The tub 14 in the right side view, as shown in FIG. 3, is provided with a pair of support brackets 42 and 44. The tub 14, in the left side view as shown in FIG. 4, is provided with a pair of support brackets 46 and 48. The tub support brackets 42 and 46 are bolted to the front wall 16 with bolts 50, as shown in FIGS. 3 and 4. Similarly, the support brackets 44 and 48 are bolted to the rear wall 18 with bolts 52. In this manner, tub 14 is fixedly secured to base 12.

As shown in FIGS. 1–3, the right side of the tub 14 is provided with a pair of lifting eyelets 54 and 56, and the left side of tub 14 is provided with a pair of lifting eyelets 58 and 60.

Tub 14 is also provided with a clean-out door 62 which is hingedly attached with end wall 40 of tub 14, with a piano hinge 64, as shown in FIGS. 2 and 3. A pair of over-center clamps 66 each have one end attached to clean-out door 62 and are pivotly secured to posts 68. The over-center clamps have a handle portion 70 which, when pulled, pivot the clean-out door away from the end wall 40 to permit entry to the inside of tub 14 at the bottom thereof.

Figure 5:
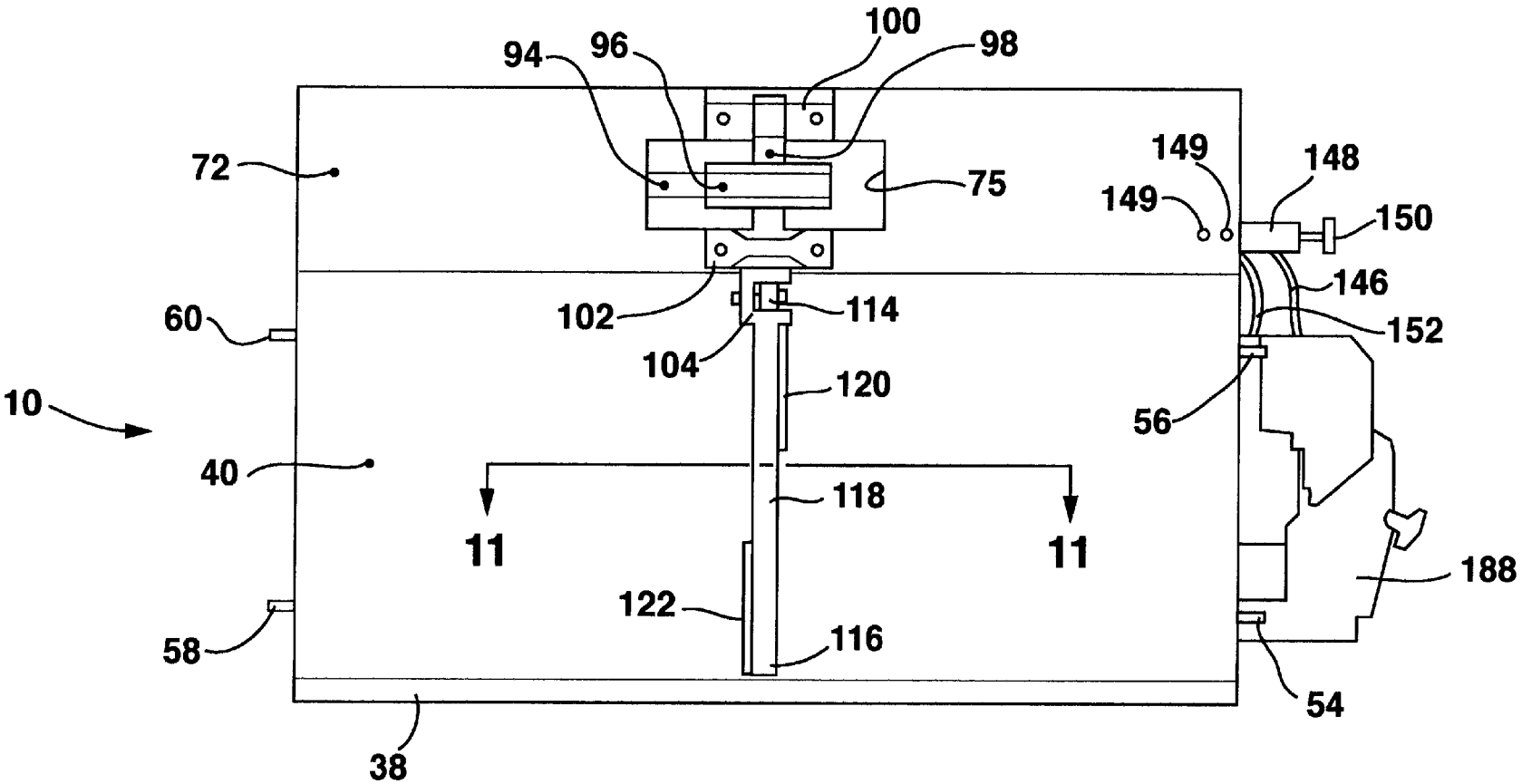
FIG. 5 is a top view of the invention shown in FIG. 1.

A bearing support shelf 72 is welded to end wall 40 of tub 14, as shown in FIG. 4. The shelf 72 has a depending end portion 74 and a cutout 75, as shown in FIGS. 4 and 5. Four shelf brackets, 76, 78, 80 and 82, are welded to end wall 40 as well as shelf 72 to support the shelf, as shown in FIG. 2. Each of the shelf brackets 76, 78, 80 and 82 have a slot 84 and hole 85, as shown in FIGS. 3 and 4.

A pair of mounting brackets 86 and 88 are welded to shelf 72, as shown in FIG. 4. A hydraulic cylinder 90 has one end pivotally attached to brackets 86 and 88 with a pin 92, as shown in FIGS. 2 and 4. The pin 92 extends through aligned holes provided in brackets 86 and 88. Hydraulic cylinder 90 is provided with a rod 94 which is pivotally mounted to an end of bell crank 96, as shown in FIG. 2. The bell crank 96 is positioned to extend through cutout 75 in shelf 72 as shown in FIG. 5. The hydraulic cylinder 90 is positioned to extend through slots 84 in brackets 80 and 82, as shown in FIGS. 2 and 4. The other end of bell crank 96 is fixedly mounted to an axle shaft 98, as shown in FIG. 5. Axle 98 is supported by two pillow block bearings 100 and 102. The pillow block bearings 100 and 102 are mounted to bearing support shelf 72 by any conventional means, such as bolts.

Figure 7:
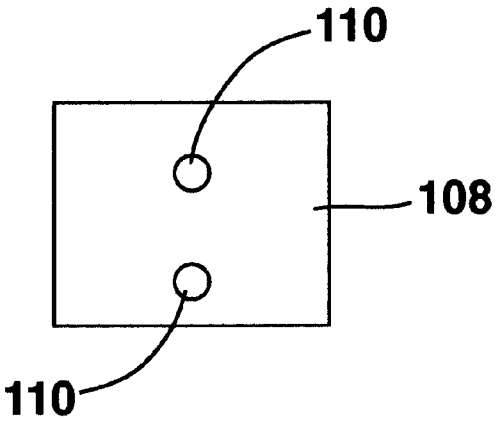
FIG. 7 is a left side elevational view of the coupler shown in FIG. 6.
Figure 6:
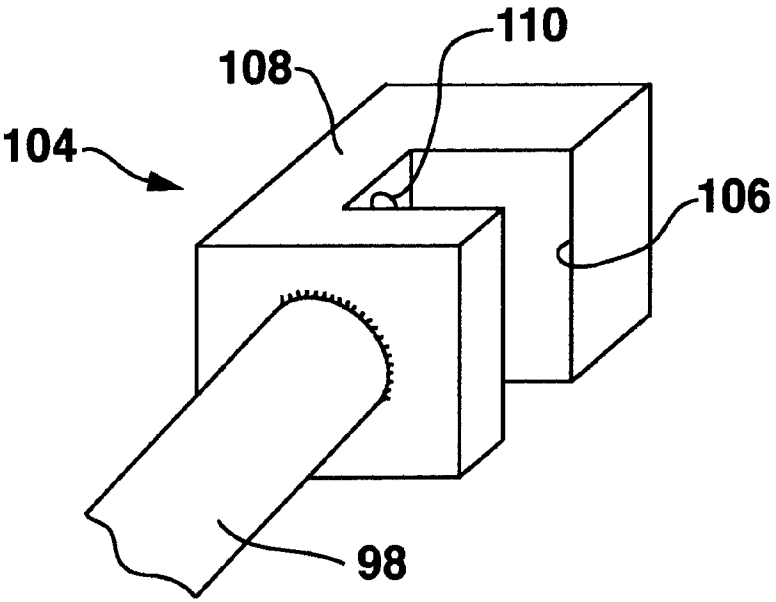
FIG. 6 is a perspective view of a paddle coupler used with the present invention.

A paddle coupler 104 is fixedly mounted to an end of axle 98, as shown in FIGS. 5 and 6. The paddle coupler is a rectangular block having a rectangular slot 106 therethrough, as shown in FIG. 6. The coupler 104 includes a wall 108 through which a pair of bolt holes 110 are provided, as shown in FIG. 7. The paddle coupler 104 is used to secure a paddle 112 in tub 14.

Figure 8:
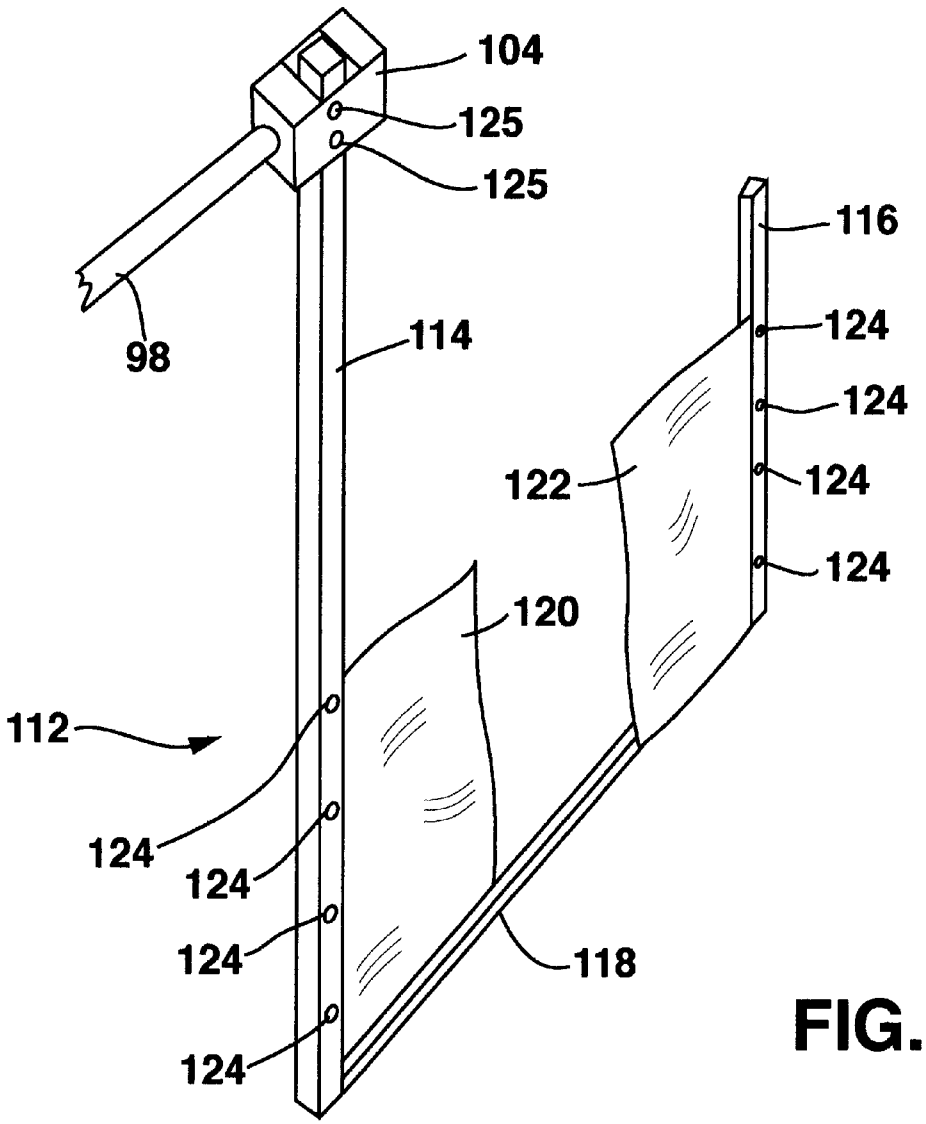
FIG. 8 is a perspective view of a paddle used with the present invention mounted in a coupler shown in FIG. 6.

Paddle 112 is provided with a pair of upright scraper bars 114 and 116, as shown in FIG. 8. Uprights 114 and 116 are connected with bottom scraper 118. The paddle 112 is sized to scrape the bottom and sidewalls of tub 14 when mixing mortar. The bottom scraper 118 is sized to have a length approximately the width of tub 14, and the upright 114 is sized to be approximately the radius of semicircular tub 14. In addition, rubber flaps 120 and 122 are bolted to uprights 114 and 116, respectively, as shown in FIG. 8, with bolts 124, which flaps aid in the mixing process. The paddle 112 is mounted in the tub 14 by extending upright 114 through the slot 106 provided in paddle coupler 104. Paddle upright 114 is further provided with a pair of holes to be aligned with holes 110 in coupler 104. Bolts 125 are inserted through the corresponding holes 110 and the holes in upright 114, and a nut screwed onto the bolt to secure the upright 114 in the slot 106 of paddle coupler 104.

Figure 9:
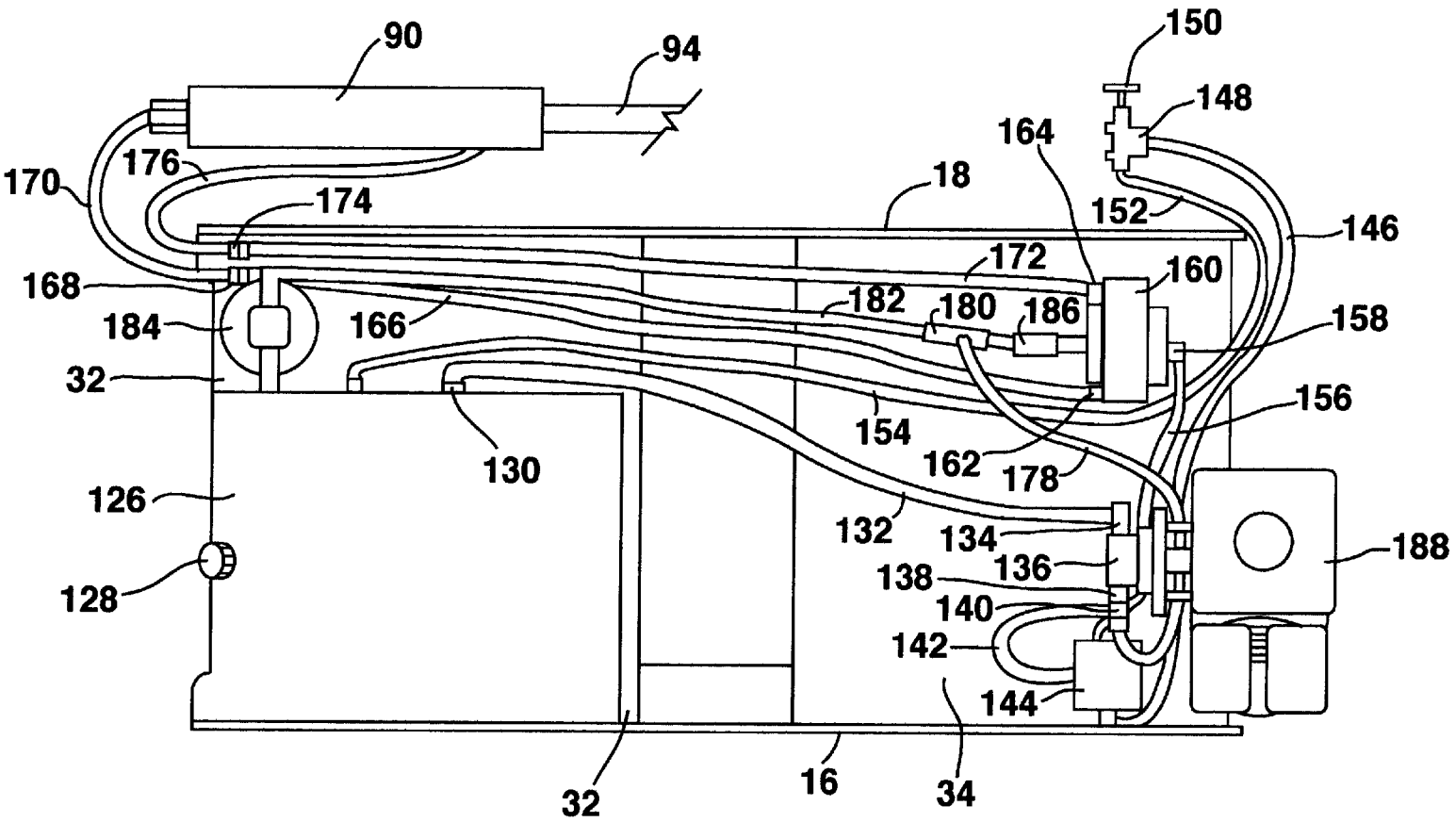
FIG. 9 is a top view of the base shown in FIG. 1 with the mortar mixing tub removed.
Figure 10:
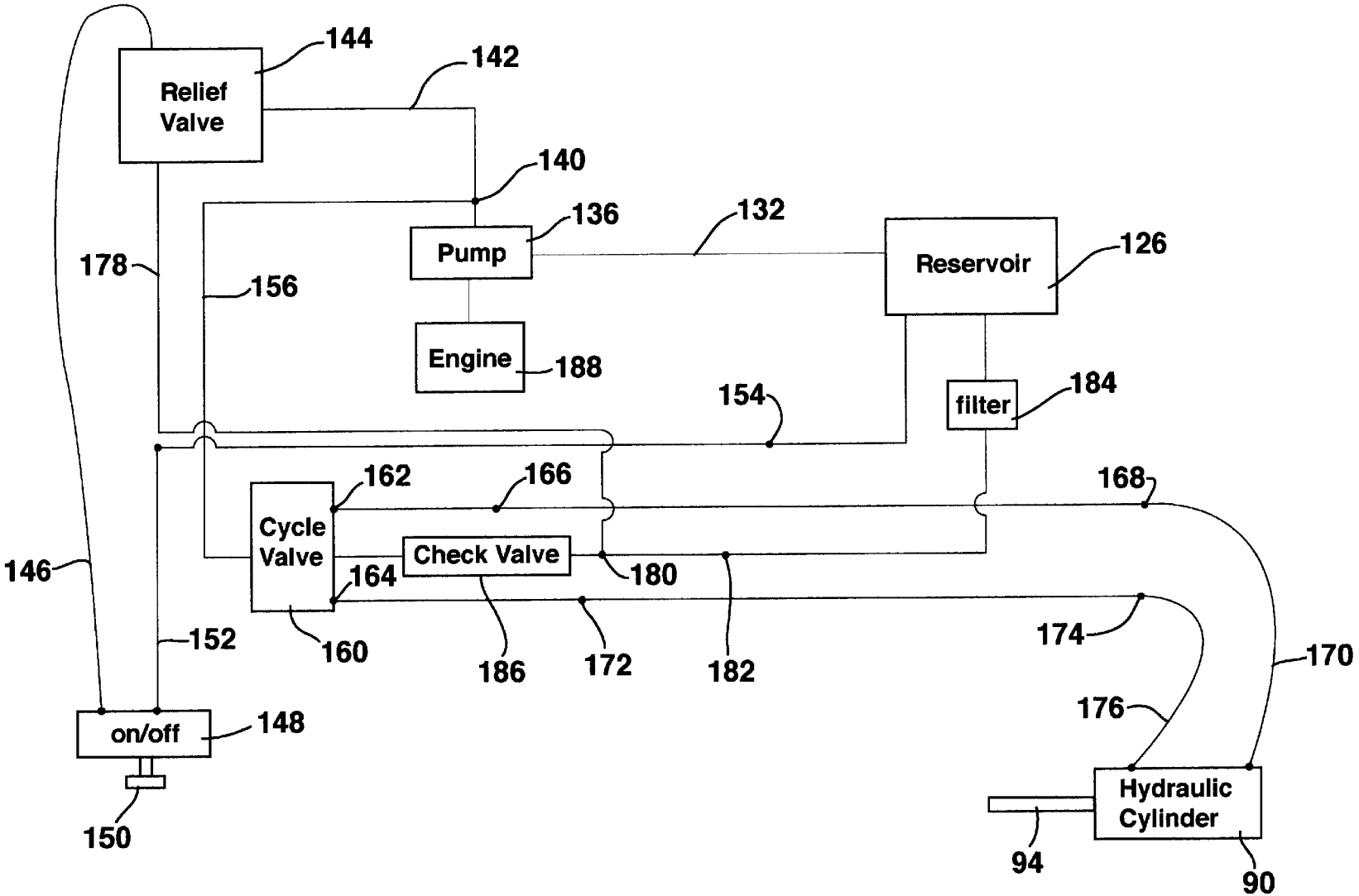
FIG. 10 is a schematic view of the hydraulic system used with the present invention.

The hydraulic system for moving the paddle 112 with a back and forth motion is shown in FIGS. 9 and 10. The hydraulic system is mounted on the base 12 as shown. A hydraulic fluid reservoir 126 rests on top of base channel 32, as shown in FIG. 9, and is mounted thereto as by welding. The reservoir includes a fill spout with cap 128, and a hydraulic fluid supply port 130. A supply line 132 fluidly connects supply port 130 with inlet port 134 of hydraulic pump 136.

In a preferred embodiment, the hydraulic pump 136 is a conventional gear pump. The hydraulic pump 136 includes an outlet port 138 fluidly connected to a "T" 140. One branch of the "T" 140 is fluidly connected to one end of a line 142. The other end of line 142 is connected to one port of a three-port ventable relief valve 144. A line 146 fluidly connects another port of relief valve 144 with an on/off selector valve 148. In a preferred embodiment, the on/off valve 148 is a two-position, three-port selector valve with a detent, and is operated by pushing and pulling the handle 150. The on/off valve 148 is mounted to shelf 72, adjacent the upper edge of tub 14, with bolts 149, as shown in FIG. 5. A line 152 has one end connected to the on/off valve 148 and the other end connected to a drain line 154. The other end of drain line 154 is returned to the reservoir 126.

A second branch of the "T" 140 is fluidly connected with a line 156. The line 156 has its other end connected to an inlet port 158 of an automatic cycle valve 160. In a preferred embodiment, the cycle valve 160 is a four-way, two-position pressure actuated automatic cycle valve. The cycle valve 160 has two outlet ports, 162 and 164. A hydraulic line 166 fluidly connects port 162 with an external outlet port 168, as shown in FIGS. 4 and 9. A line 170 is led through hole 85 (shown in FIG. 4) in bracket 82 and connects port 168 with the blind end of hydraulic cylinder 90, as shown in FIGS. 2, 4 and 9.

A line 172 fluidly connects port 164 with an external outlet port 174, as shown in FIGS. 4 and 9. A line 176 connects the outlet port 174 to the rod end of hydraulic cylinder 90, as shown in FIGS. 2 and 9.

A drain line 178 is connected to the ventable relief valve 144, and has its other end connected to "T" 180. A return line 182 is connected to one branch of the "T," and has its other end connected to a filter 184 which in turn is fluidly connected to the reservoir 126.

A check valve 186 has one end connected to the other branch of "T" 180, and has its other end connected to a port of the cycle valve 160. The check valve allows fluid flow toward reservoir 126, but prevents fluid flow to cycle valve 160.

An engine 188 is provided for powering the gear pump 136. The drive shaft of engine 188 is connected to the drive spindle of gear pump 136 in a conventional manner. The engine 188 is supported by a shelf 190 which has been welded to base channel 32, as shown in FIGS. 1–3.

In a preferred embodiment, the engine 188 is a gasoline engine, but it is contemplated that other pump driving means, such as an electrical motor, could be used equally as well.

Figure 11:
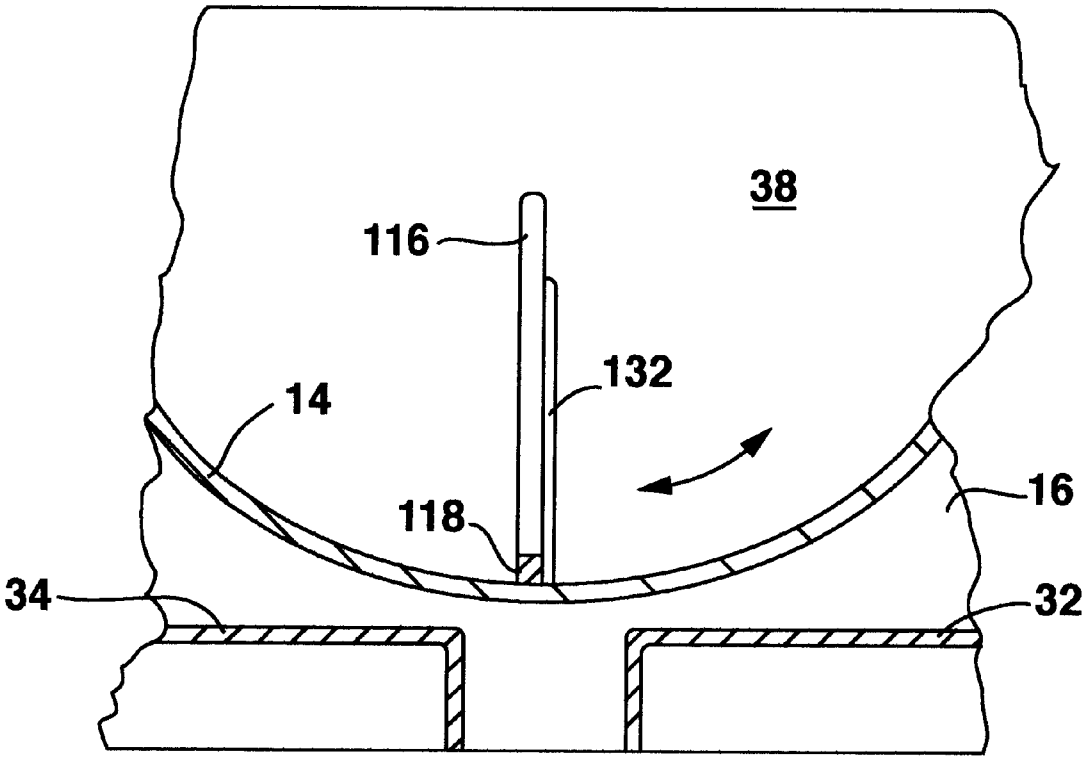
FIG. 11 is a cross-sectional view taken along the line 11—11 in FIG. 5.

In operation, when the engine 188 is driving pump 136 and the on/off valve 148 is turned "on," relief valve 144 is closed because the hydraulic pressure in valve 144 is low. Hydraulic fluid is then drawn through supply line 132 from the reservoir 126 and directed to the cycle valve 160 through line 156. The cycle valve supplies hydraulic fluid to either port 162 or port 164 on an alternating, automatic basis. The hydraulic fluid then forced through either line 166 or line 172 to corresponding lines 170 or 176 to hydraulic cylinder 90. The hydraulic cylinder 90, in this way, is driven in a reciprocating manner since line 170 is connected to the blind end of cylinder 90, and line 176 is connected to the rod end of cylinder 90. The paddle 112 is caused to sweep back and forth in a continuous manner within the tub 14 to mix the mortar, as shown in FIG. 11. Mixing occurs within the tub without the paddle ever moving outside of the trough.

Fluid flow in lines 170 and 176 are in opposite directions. That is, when fluid is being forced to hydraulic cylinder 90 in one line, fluid is draining back to the reservoir in the other line. The drain flow path is through the cycle valve 160, through check valve 186 and to line 182.

When the on/off valve 148 is turned "off," the hydraulic pressure builds in the relief valve 144 until it opens. Hydraulic fluid from the pump 136 is then directed back to the reservoir 126 through supply line 132, line 142, relief valve 144, line 178 and drain line 182.

When it is desired to move the portable mortar mixer 10, a forklift may be used. The forklift tines are inserted in channels 32 and 34, the mixer lifted and transported to a new site. Further, the forklift can be used to raise the mixer to position when a workman is working on a job site. If a forklift cannot lift the mixer to a sufficient height, a crane can be used with a chain connected to eyelets 54–60. In this manner, the mixer can be positioned next to the workman who is using the mortar.

By positioning the bearings 100 and 102 outside the trough of tub 14, the mortar being mixed does not interfere with the operation of the bearings. Further, by mounting only one end of the paddle 114 to axle 98, the paddle can be moved to one side or the other for easier clean out. There is no axle which extends across the tub to interfere with the clean out.

While the fundamental novel features of the invention have been shown and described, it should be understood that various substitutions, modifications and variations may be made by those skilled in the art without departing from the spirit or scope of the invention. Accordingly, all such modifications or variations are included in the scope of the invention as defined by the following claims:

I claim:

1. A portable mixer comprising:

an open top mixing tub having a trough with a semicircular cross-section about an axis of rotation and a pair of end walls each welded to a respective end of the trough for closing each end of the trough;

a base for fixedly supporting the mixing tub;

the base provided with a pair of spaced-apart box channels extending through the base and aligned in a horizontal plane;

a paddle positioned within the mixing tub;

an axle mounted to the mixing tub adjacent the top of the mixing tub and axially aligned with the axis of rotation;

the paddle including a first upright scraper having upper and lower ends, a second upright scraper having upper and lower ends with the first and second upright scrapers positioned in parallel relation and further including a bottom scraper having two ends with one end attached to the lower end of the first upright scraper and the lower end of the second upright scraper, and wherein the upper end of the first upright scraper is secured to the axle and further wherein the first upright scraper, the second upright scraper and the bottom scraper are all positioned within an axial plane of the axle;

the paddle sized and shaped to scrape the trough and the end walls of the mixing tub; and an actuator for rotating the axle back and forth whereby the paddle is caused to sweep back and forth within the trough.

2. The portable mixer according to claim 1 wherein lifting eye hooks are mounted to the mixing tub.

3. The portable mixer according to claim 1 further including an axle bearing positioned outside the trough of the mixing tub and wherein the axle has an end positioned outside the trough and is supported by the axle bearing.

4. The portable mixer according to claim 3 wherein a bell crank is mounted to the end of the axle positioned outside the trough, and wherein the actuator includes hydraulic means for moving the bell crank back and forth.

5. The portable mixer according to claim 3 wherein a flexible flap has one edge mounted to the first upright scraper and a second flexible flap has one edge mounted to the second upright scraper.

6. The portable mixer according to claim 1 wherein the first upright scraper is sized to have a length equal to the radius of the semicircular trough, and the bottom scraper has a length equal to the distance between the end walls of the mixing tub.

7. The portable mixer according to claim 1 wherein the actuator includes hydraulic means having a hydraulic pump and further includes a gasoline engine for driving the hydraulic pump.

8. The portable mixer according to claim 1 further including a clean out door positioned in one of said end walls adjacent the bottom of the trough.

* * * * *